US005775041A

United States Patent [19]

Tull et al.

[11] Patent Number: 5,775,041

[45] Date of Patent: Jul. 7, 1998

[54] DOOR ENTRY SYSTEM

[75] Inventors: Michael Tull, Roswell, Ga.; J. Manning McPhillips, Mobile, Ala.

[73] Assignee: McPhillips Manufacturing Co. Inc., Mobile, Ala.

[21] Appl. No.: 505,065

[22] Filed: Jul. 21, 1995

[51] Int. Cl.[6] ..... E06B 3/70

[52] U.S. Cl. ..... 52/455; 52/457; 52/656.9; 52/204.597; 49/501; 403/231; 312/257

[58] Field of Search ..... 52/455, 456, 457, 52/458, 656.4, 656.9, 204.597; 49/501; 403/231; 312/257.1, 257.5

[56] References Cited

U.S. PATENT DOCUMENTS

| | | | |
|---|---|---|---|
| 2,706,543 | 4/1955 | Kammerer | 52/455 |
| 3,100,917 | 8/1963 | Wagner | 52/455 X |
| 4,013,371 | 3/1977 | Nagase | 52/455 X |
| 4,078,288 | 3/1978 | Abramson | 52/455 X |
| 4,550,540 | 11/1985 | Thorn | 52/309.4 |
| 4,901,493 | 2/1990 | Thorn | 52/455 X |
| 5,082,605 | 1/1992 | Brooks et al. | 264/40.6 |
| 5,088,910 | 2/1992 | Goforth et al. | 425/142 |
| 5,096,046 | 3/1992 | Goforth et al. | 193/604 |
| 5,261,203 | 11/1993 | Yoon | 52/656.9 X |
| 5,325,648 | 7/1994 | Menard | 52/456 |
| 5,361,552 | 11/1994 | Fulford | 52/455 |
| 5,363,625 | 11/1994 | Philippi | 52/656.9 X |

FOREIGN PATENT DOCUMENTS

WO 95/13179 5/1995 WIPO .

*Primary Examiner*—Carl D. Friedman
*Assistant Examiner*—Winnie Yip
*Attorney, Agent, or Firm*—Arnall Golden & Gregory, LLP

[57] ABSTRACT

Durable, high strength entry systems and methods for their manufacture are provided. The entry systems are formed by assembling profiles produced by extruding and then machining and/or molding a composite material. The profiles are formed in a preferred embodiment by extruding a cellulose composite material to produce an extrusion which preferably contains hollow sections which reduce the weight and cost of the material. The extruded composite can be machined and/or molded after the extrusion process to provide means for securing the profiles to each other or to glass and panel inserts. Entry systems, such as sidelights, transoms and exterior doors, can be produced from the assembled profiles which are durable and strong and therefore resist corrosion, denting and decay. The entry systems can be produced from low cost wood substitutes and provide the appearance of real wood. The entry systems can be readily treated with paint or other finishing materials to provide the desired exterior finish.

7 Claims, 6 Drawing Sheets

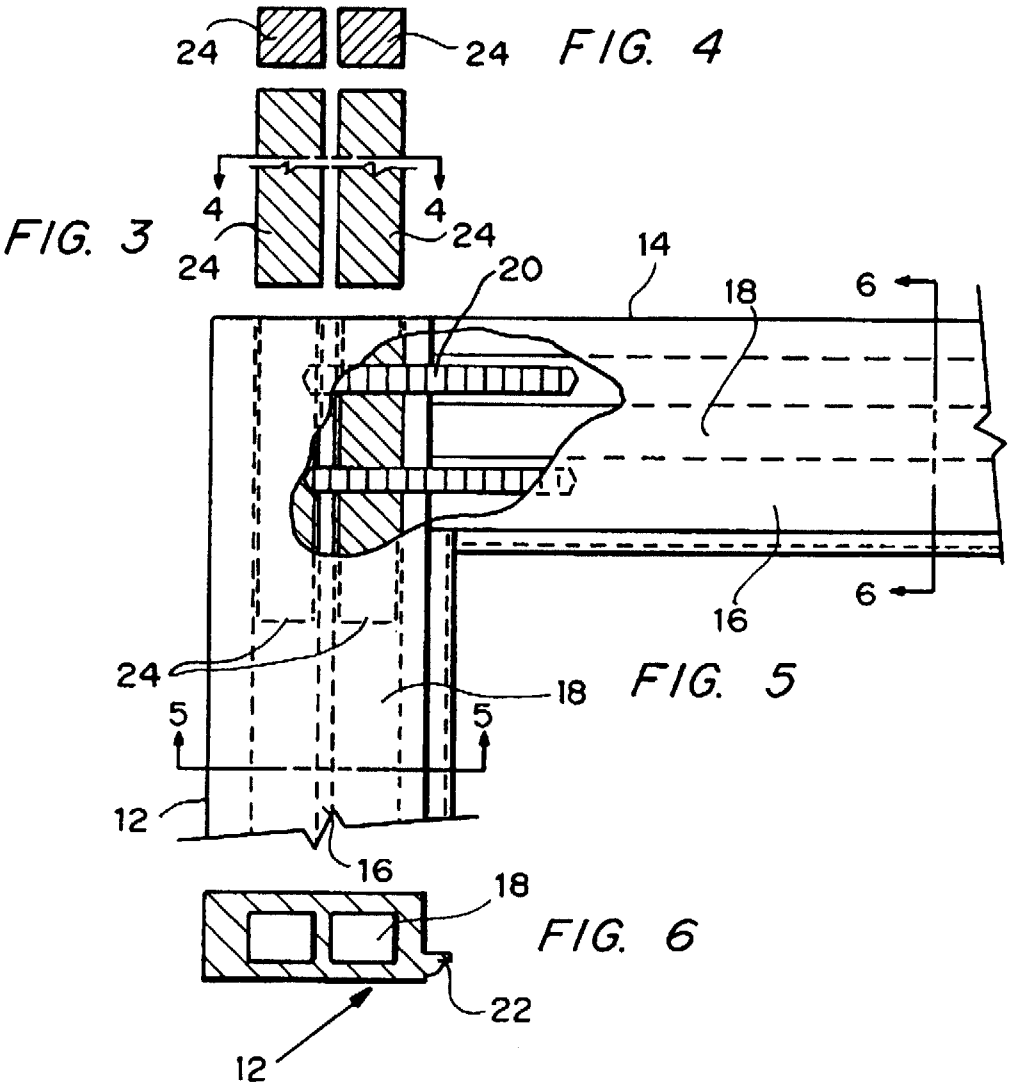
FIG. 3
FIG. 4
FIG. 5
FIG. 6
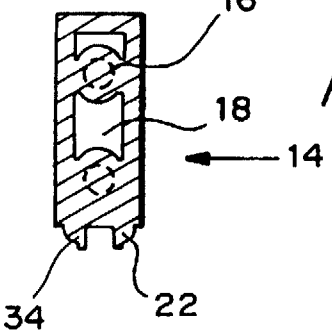
FIG. 7
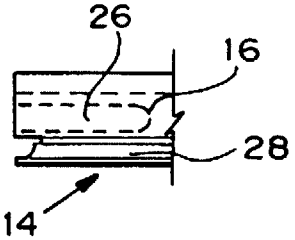
FIG. 8

DOOR ENTRY SYSTEM

BACKGROUND OF THE INVENTION

The present invention relates to entry systems, including doors and sidelights, which are formed from assembled profiles of composite materials and glass.

A variety of structures and materials have been used to manufacture exterior and interior doors. For example, solid wood components may be milled to form solid wood stiles, rails and panels which are fitted and secured together to form a door. The use of wood materials is disadvantageous, however, due to the high cost of wood resulting from depletion of the world's forests. Methods for making synthetic wood products have been described in the prior art, for example in U.S. Pat. Nos. 5,088,910 and 5,096,046 to Goforth et al., U.S. Pat. No. 5,082,605 to Brooks et al., and PCT WO 95/13179.

Modified door assemblies have been developed, which include, for example, foam insulation. U.S. Pat. No. 5,361,552 to Fulford discloses a wooden door assembly which includes a wooden subframe stile and rail assembly, an insulated foam core and an exterior veneered or solid wood stile, rail and raised panel assembly. U.S. Pat. No. 4,901,493 to Thorn discloses a door assembly having compression molded frame skins defining a central opening for receiving a foam core.

There is a need for door entry systems which are inexpensive to make and easy to manufacture, and which are strong, durable and capable of withstanding a variety of weather conditions. There also is a need for entry systems which can be formed from readily available starting materials.

It is therefore an object of the invention to provide entry systems, including doors and sidelights, which are strong and durable, yet which are also inexpensive to manufacture on a large scale. It is another object of the invention to provide entry systems from components which can be molded into a preselected shape prior to assembly. It is a further object of the invention to provide entry systems which can be readily assembled with sheets of glass incorporated therein. It is yet another object of the invention to provide methods for the rapid manufacture of entry systems, such as exterior doors, using materials which are inexpensive, durable and readily available.

SUMMARY OF THE INVENTION

Durable, high strength entry systems and methods for their manufacture are provided. The entry systems are formed by assembling and securing together profiles produced by extruding and machining and/or moulding a composite material. The profiles can be formed by extruding cellulose composite materials in, for example, a cold extrusion process, to produce an extrusion. The extrusion preferably contains hollow sections to reduce the weight and cost of the material. The extrusion then is moulded and/or machined to provide means for attaching and securing the profiles to each other or to glass and panel inserts. Entry systems, such as sidelights, transoms and exterior doors, can be produced from the assembled profiles which are durable and strong and therefore resist corrosion, denting and decay. The entry systems can be produced from low cost wood substitutes and provide the appearance of real wood. The entry systems can be readily treated with paint or other finishing materials to provide the desired exterior finish.

BRIEF DESCRIPTION OF THE DRAWINGS

FIG. 3 is a cross-sectional plan view of stile plugs which are inserted into hollow sections at the end of a stile during door assembly.

FIG. 4 is a cross-sectional view of stile plugs 24 taken through line 4—4 of FIG. 3.

FIG. 5 is a partial cross-sectional plan view of an interlocking rail and stile in the door of FIG. 1.

FIG. 6 is a cross-sectional view of stile 12 taken along line 5—5 of FIG. 5.

FIG. 7 is a cross-sectional view of rail 14 taken along line 6—6 in FIG. 5.

FIG. 8 is a partial cross-sectional view of a rail with a coped joint.

DETAILED DESCRIPTION OF THE INVENTION

Door entry systems, including doors, sidelights, and transoms are provided which are manufactured from a composite such as a cellulose composite material. Optionally, glass can be incorporated into the entry system. The door entry systems are produced by extruding a composite using an extruder into a preselected shape. The extruded profiles are preferably hollow to reduce the weight. The profiles then are further moulded and/or machined into the desired shape using, for example, a turn, mill, drill, sand, saw, miter, rout or plane, and then are assembled into the desired entry system. The profiles can be fabricated such that they readily interfit with each other and with glass components during assembly. Composite materials which can be extruded to form the profiles include Strandex™, manufactured by Strandex Corp., Madison, Wis., which is a blend of wood flour, high density polyethylene and polyurethane.

In one embodiment, an exterior door may be assembled from composite profiles. The profiles are formed by extruding a composite and then moulding and/or machining the extrusion to form top and bottom rail profiles and at least two stile profiles. The rail and stile profiles then are secured to each other, and optionally to additional components such as glass or panels, using an attachment or securing means such as a dowel, hinge, nail, glue, screw or a staple. The profiles additionally can be prefabricated at each end for dowel insertion or can be otherwise adapted to permit the profiles to interfit.

Figure 2:
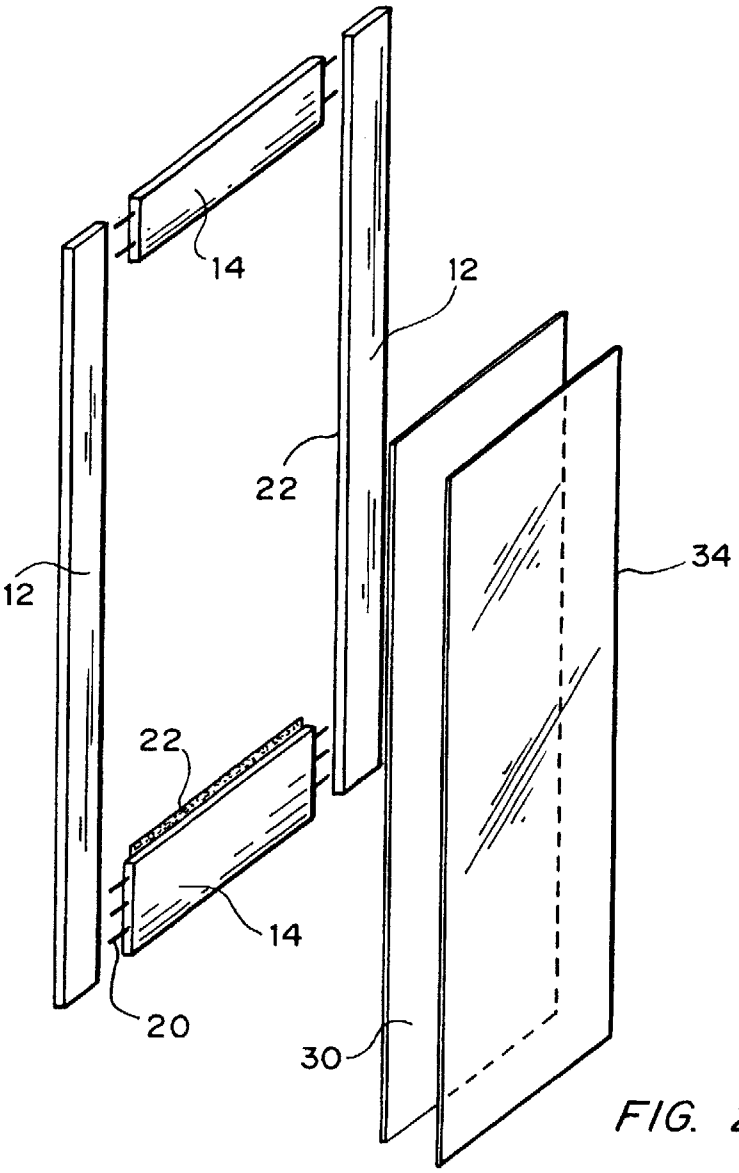
FIG. 2 is an exploded view of the door of FIG. 1 showing the rails, stiles, glass, and glazing stop which are assembled and secured to form the door.
Figure 1:
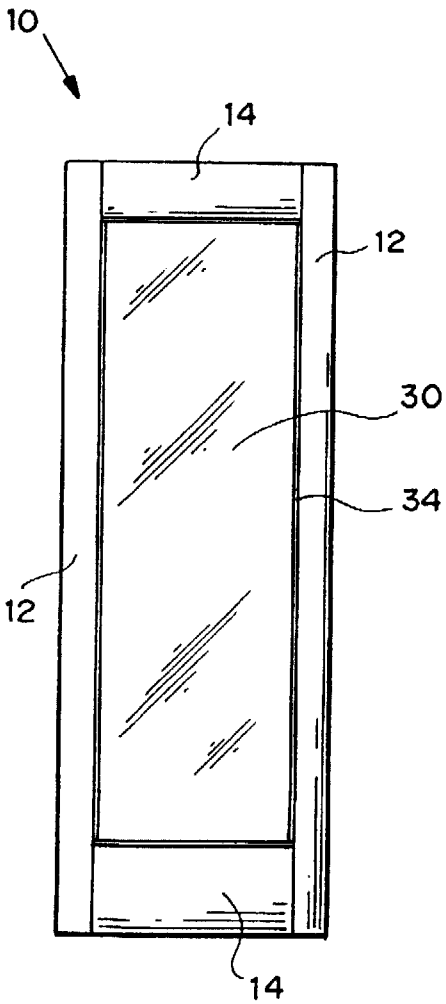
FIG. 1 is a front elevational view of a door made by assembling preformed composite profiles.
Figure 13:
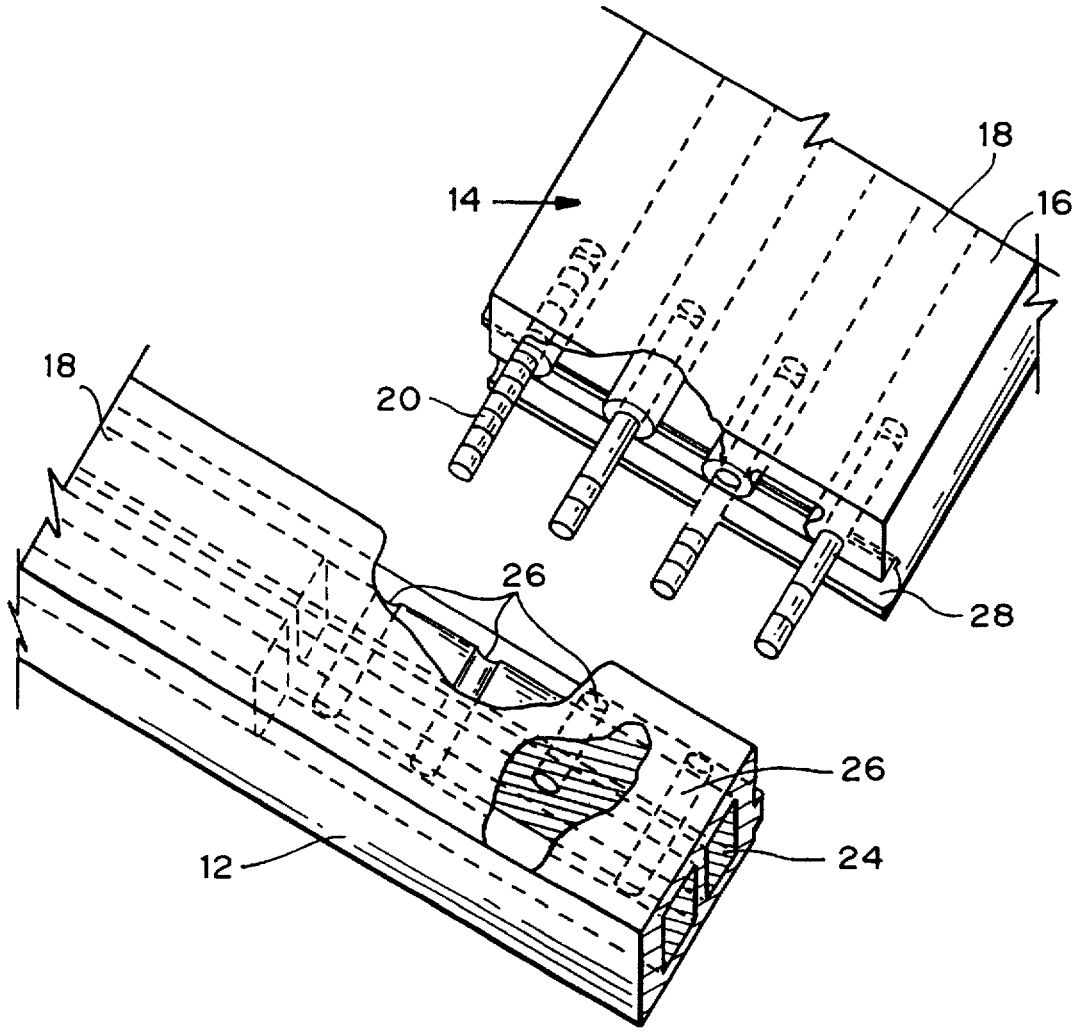
FIG. 13 is a partial cross-sectional plan view of an interlocking rail and stile in the door of FIG. 1.

Referring to the drawings wherein like numerals indicate like parts, one embodiment of a door 10 which may be assembed from preformed composite profiles is shown in FIGS. 1 and 2. The upper left corner of door 10 is shown in more detail in FIG. 5, and the lower right corner is shown in FIG. 13. Door 10 is assembled from top and bottom rails 14 and from side stiles 12. Rail profile 14, as shown in more detail in FIGS. 7 and 8, and stile 12, shown in FIG. 6, are fabricated during the extrusion with hollow sections 18, and with internal web members 16. The web member may be extruded into a preselected size and shape, for example in cylindrical form, for a particular application. The hollow sections reduce the weight of the profile and reduce the cost of the material, while the web members improve structural strength and permit a dowel or other means to be inserted therein for securing the rail profile to the stile profile. The profiles may optionally have varying widths and heights as needed for a particular application. For example, the width of the lower profile can be increased relative to the upper profile to provide additional support for a glass or panel insert.

In the embodiment shown in FIGS. 5 and 13, the round web members 16 in rail 14 are bored at each end and a dowel pin 20 is inserted into the bored hole. The stile profile 12 includes hollow sections 18 into which stile plugs 24, shown in detail in FIGS. 3 and 4, are inserted. The stile plug 24 can be designed and fabricated from an extruded composite or other material with a preselected shape to fill the void in each end of the stile. The end of the stile 12 with the inserted stile plug 24 can include a bored hole 26 which interfits with dowel 20 in bored hole 26 in rail 14, as shown in FIGS. 5 and 13. The rail 14 also may be fabricated during or after the extrusion process with a coped joint 28 shown in FIG. 8 which interfits with the stile profile 12. Thus, the style and rail extruded profiles can be moulded to a preselected shape to permit them to be interfitted and secured, and assembled into an entry system such as a door, sidelight or transom.

Figure 10:
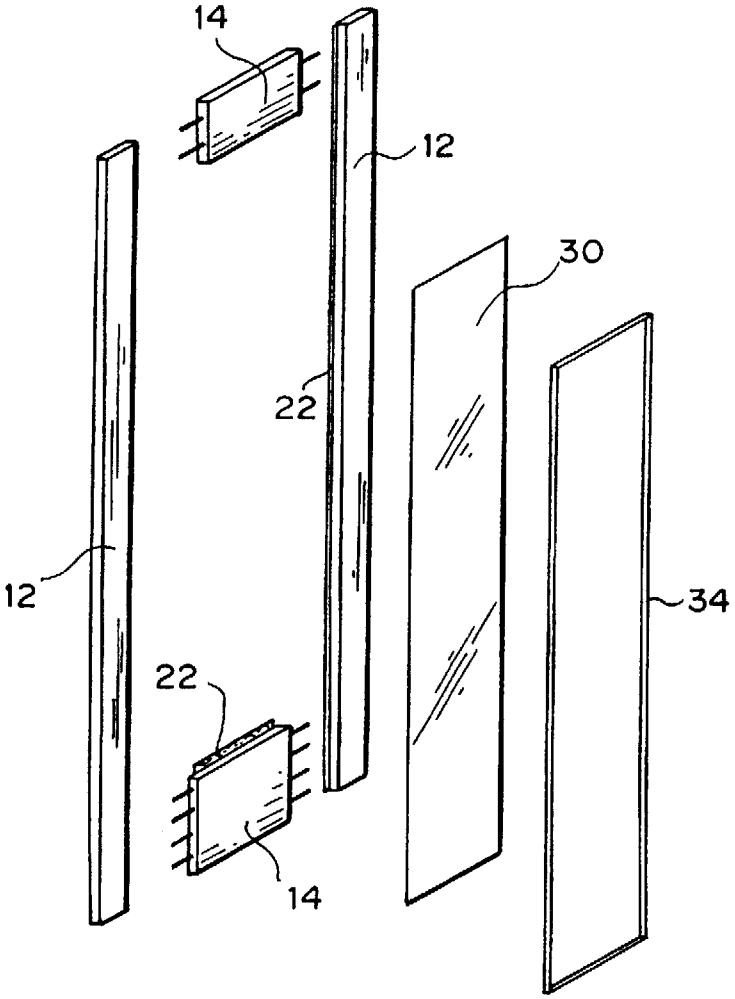
FIG. 10 is an exploded view of the sidelight of FIG. 9 showing the rail, stiles, glass and glazing stop which are secured to form the sidelight.
Figure 9:
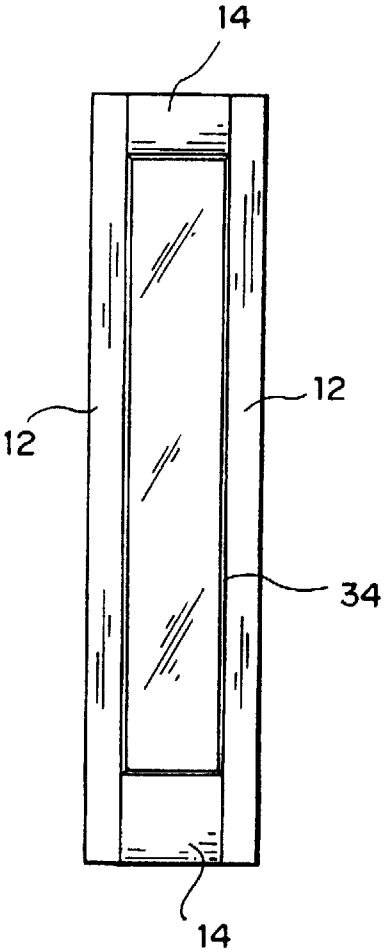
FIG. 9 is a front elevational view of a sidelight made from assembled synthetic composite profiles.
Figure 15:
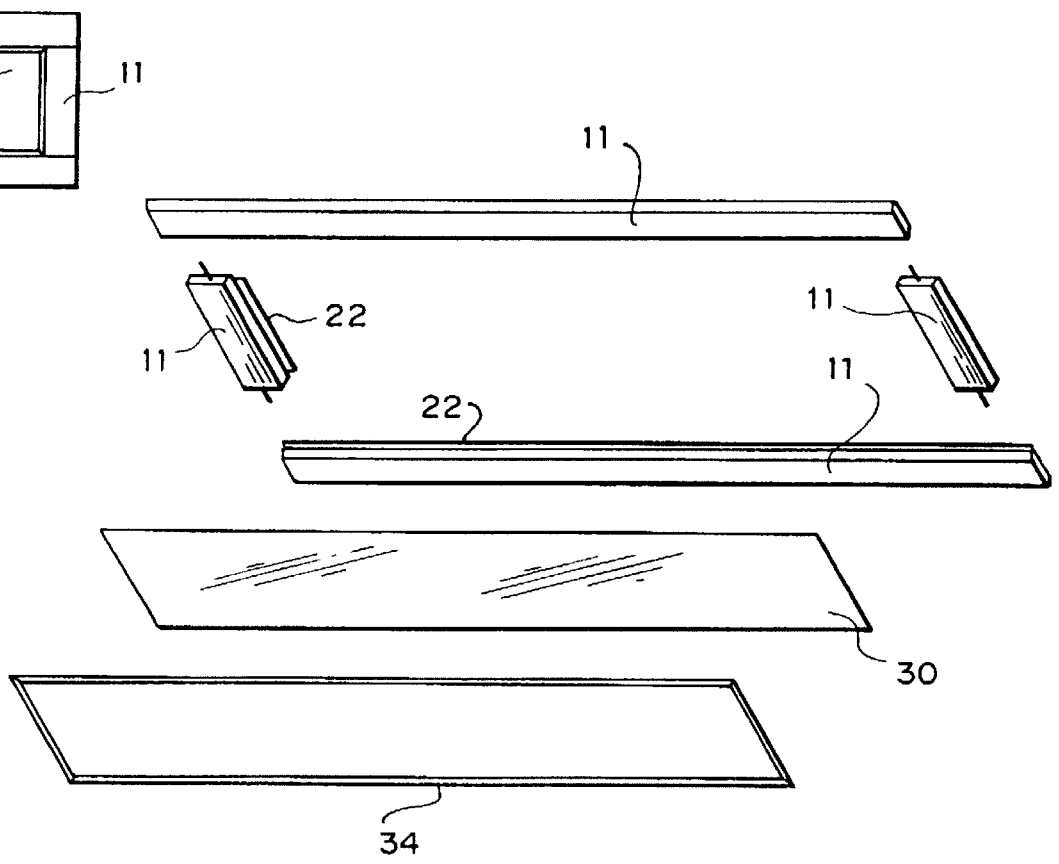
FIG. 15 is an exploded view of the transom of FIG. 14 showing the profiles, glass and glass stop, which are secured to form the transom.
Figure 14:
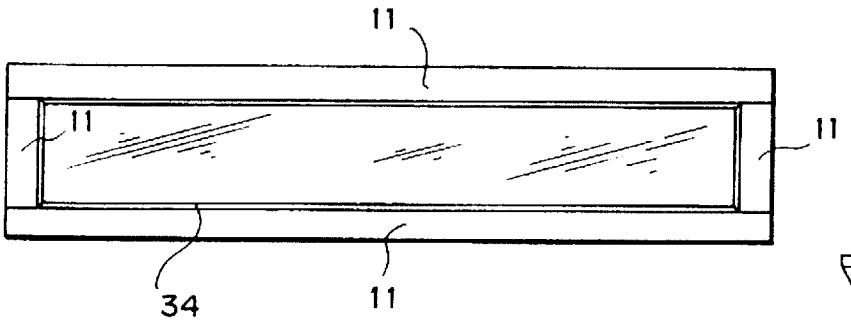
FIG. 14 is a front elevational view of a transom made from assembled composite profiles.

Doors, sidelights and transoms can be formed from assembled profiles which include a glazing stop which interfits with one or more glass plates. As illustrated in FIGS. 6 and 7, the rail and stile profiles in the doors can include a glazing stop 22 which interfits with a glass plate. The glazing stop can be formed during the extrusion process and then optionally further machined into a preselected shape. In the embodiment shown in FIG. 2, door 10 includes glazing stop 22 which interfits with glass plate 30. Single, dual, or triple pane insulating glass can be utilized. The glass is glazed into the door or sidelight against the glazing stop. A removable glazing stop 34 of the same or different material can be installed against the glass and secured to the stile and rail to complete the assembly as shown in FIG. 2. In another embodiment, a sidelight is similarly assembled as shown in FIGS. 9 and 10. Additionally, as shown in FIGS. 14 and 15, a transom may be assembled from composite profiles 11 which include glazing stop 22 to which glass plate 30 and then glazing stop 34 are attached.

Figure 12:
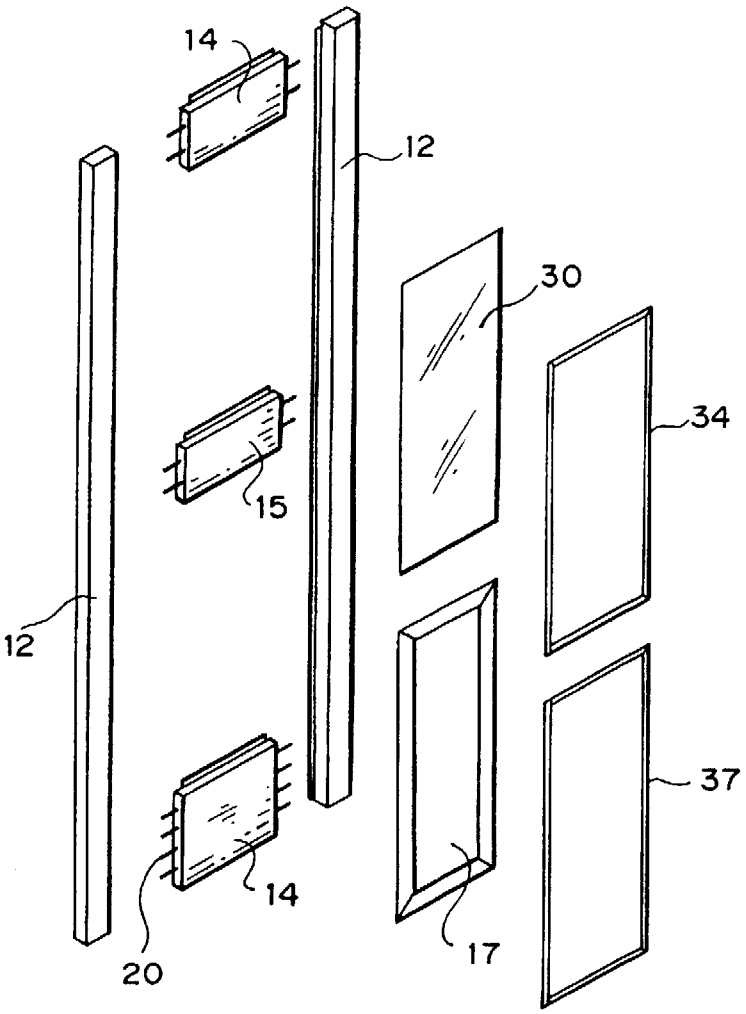
FIG. 12 is an exploded view of the sidelight of FIG. 11 showing the rail, stiles, glass, raised panel, glazing stop and panel stop, which are secured to form the sidelight.
Figure 11:
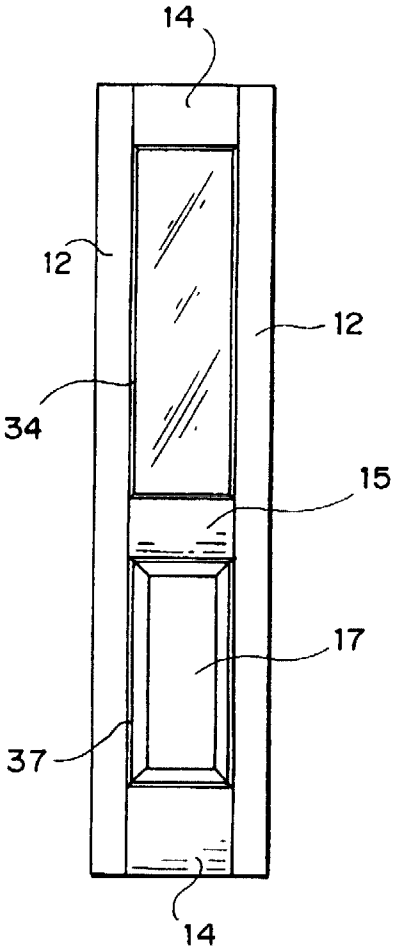
FIG. 11 is a front elevational view of a sidelight containing a raised panel made from assembled composite profiles.

As shown in FIGS. 11 and 12, the door or sidelight also can be assembled using a combination of glass and raised panels 17 or assembled using only raised panels. The raised panels can be formed from a composite as an extrusion and then moulded and/or machined into a panel profile which interfits with the rails and stiles and, optionally one or more glass plates via a dowel, glazing stop or other attachment means. The panel profiles can be raised on all four sides and on the front and back side. FIGS. 11 and 12 show an embodiment of a sidelight including top and bottom rails 14, which interfit with stiles 12 via dowels 20 and a coped joint. The sidelight further includes a glass plate 30, center rail 15 and raised panel 17. As shown in the exploded view in FIG. 12, the raised panel 17 and the glass plate 30 fit against the glazing stop 22 on the rails and stiles, and a glass stop 34 and panel stop 37 of the composite material or a different material is installed against the glass and panel to secure them to the sidelight.

A variety of entry systems, including exterior doors, patio doors, transoms, windows and sidelights of varying sizes can be fabricated. For example, doors with a width of 1 to 4 feet, and a height of 6 to 8 feet can be manufactured. The profiles can be sealed and filled using standard silicone seals, acrylic seals or wood fillers, either before or after assembly. The profiles and/or assembled entry systems can be finished by the application of paint with primer, a stain, emboss, veneer, laminate, polyurethane, varnish or lacquer or by other finishing materials available in the art.

The profiles used to form the entry system can be formed, for example, in a cold extrusion process from a composite, such as Strandex™, which is derived from wood flour, then can be further machined and/or moulded by cutting and shaping. As used herein, the term "composite" refers to synthetic materials capable of being extruded into a durable mechanically strong profile which can be further machined and/or moulded into a preselected shape. Composites formed from organic fibrous materials can be used. In a preferred embodiment, composites formed from cellulose are used which are a useful alternative to wood, since the raw materials generally used, such as wood flour, are low cost and are readily available. Cellulose-based composites can be derived from wood or other cellulose-containing materials, such as field grown crops, including corn, or newspaper.

Strandex™ is a composite material produced from wood flour (about 35–90% by weight), high density polyethylene (about 5–35% by weight), and polyurethane (less than about 10% by weight). Methods for making Strandex™ are described in WO 95/13179, the disclosure of which is incorporated herein by reference. In the method, particles of an organic fibrous material such as a cellulosic material are combined with a thermoplastic and extruded as a homogenous mixture, and then moulded together to provide a composite material simulating wood.

Strandex™ replaces milled wood products at competitive cost and conforms to the American Society of Testing Materials ("ASTM") standards for wood, as indicated in Table 1. Table 1 shows the results of testing Strandex™ in the column under "Test Method", using ASTM standard tests for wood as described in the ASTM Standard Test Procedure Manual. As indicated in Table 1, Strandex demonstrates significantly improved properties in comparison to ponderosa pine, including hardness, durability, and low water absorption.

The use of composite materials is advantageous since they can be produced from readily available starting materials at relatively low cost. Door entry systems formed from an extrudable composite such as Strandex™ have improved properties in comparison with doors formed using conventional materials such as wood or metal. The materials can be readily extruded into a profile of a predetermined shape and with preselected properties. The resulting profiles have improved physical properties due to the chemical crosslinkage within the material.

TABLE 1

| STRANDEX ™ PROPERTIES | | | |
|---|---|---|---|
| TEST | ASTM TEST METHOD | STRANDEX ™ | PONDEROSA PINE |
| hardness | D-143 | 1,288 | 460 |
| nail withdrawal (pounds) | D-1761 | 97 | 51 |
| screw withdrawal (pounds) | D-1761 | 438 | 163 |
| water absorption | D-1037 | 0.70% | 17.20% |
| thickness swell | D-1037 | 0.20% | 2.60% |
| compression perpendicular to grain (PSI) | D-198 | 2,441 | 580 |
| compression parallel to grain (PSI) | D-198 | 2,428 | 5,320 |
| shear (PSI) | D-143 | 1,188 | 1,130 |
| tensile (PSI) | D-198 | 1,204 | 420 |
| modulus of elasticity (PSI) | D-790 | 504,600 | 1,290,000 |
| linear coefficient of expansion (per °F.) | D-696 | $1.6 \times 10^{-5}$ | $2.5 \times 10^{-6}$ |
| thermal conductivity (BTU/hr./ft.$^2$/per °F.) | C-177 | 2.03 | 1.6–2.9 |

The profiles can be used to produce entry systems such as doors, windows, transoms and sidelights which resist peeling, flaking, rust, rot, pit, blister, construction dents, and corrosion. The door entry systems provide the quality and warmth of real wood in combination with the strength of steel. The profiles used to form the door entry systems have low moisture absorption, are resistant to decay, have dimensional stability and mechanical strength, and are highly durable. The extruded profiles used to fabricate the door entry systems can be machined and pre-fit like real wood. The machined and extruded profiles formed from composite materials can be assembled into entry systems such as exterior residential, commercial and institutional entry doors, garage doors, patio doors and sidelights. The profiles also have a high quality surface for finishing treatments such as painting and varnishing.

Modifications and variations of the present invention will be obvious to those skilled in the art from the foregoing detailed description. Such modifications and variations are intended to come within the scope of the following claims.

What is claimed is:

1. An entry system comprising:

a door comprising top and bottom rails and at least two stiles wherein the rails and stiles are formed by extruding a cellulose composite material in a cold extrusion process to produce an extrusion and then molding the extrusion after the cold extrusion process; the rails and stiles each comprising at least one hollow section and at least one web member extending between at least one hollow section.

wherein the top and bottom rails comprise at least one dowel fitted in a hole bored into at least one web member of each rail, and each stile comprises at least one stile plug at each end of the stile which fits within a portion of the hollow section of the stile, and wherein each stile includes at least one hole traversely bored through the end of the stile and through the stile plug the dowel being interfitted into at least one hole of the stile plug to secure the rail and the adjacent stile together.

2. The entry system of claim 1 further comprising at least one glass plate, wherein the rails and stiles comprise a glazing stop securing the glass plate to the door.

3. The entry system of claim 1 further comprising at least one raised panel which interfits with the rails and stiles.

4. The entry system of claim 3 further comprising at least one raised panel which interfits with the rails and stiles and covers said at least one glass plate secured by the rails and stiles.

5. The entry system of claim 1, wherein ends of mating ones of the rails and stiles are shaped in a complimentary manner so as to engage and fit together, thereby forming a coped joint.

6. The entry system of claim 1, and further comprising at least one raised panel formed of extruded cellulose composite material, the at least one raised panel fitting with the rails and stiles.

7. A method for making an entry system, the method comprising:

forming profiles by extruding and molding a composite comprising an organic fibrous material to form top and bottom rails and side stiles each having a hollow section and a web member extending between the hollow section, and securing the profiles together to form an entry system by joining adjacent rails and stiles with means which includes a dowel extending outwardly from the web members of the rails traversely interfitted into a plug which fits inside the hollow sections of the stiles.

* * * * *